US005431393A

United States Patent [19]

Wang

[11] Patent Number: 5,431,393

[45] Date of Patent: Jul. 11, 1995

[54] RAISED SURFACE PATTERNS FOR BASKETBALL LEATHER COVERS

[76] Inventor: Fu-Wen Wang, 2F, No. 8, Lane 295, Sec. 1, Fu Hsing S. Rd., Taipei, Taiwan

[21] Appl. No.: 230,130

[22] Filed: Apr. 20, 1994

[51] Int. Cl.[6] ..... A63B 37/14

[52] U.S. Cl. ..... 273/65 EG; 273/58 K

[58] Field of Search ..... 273/58 K, 65 EG, 65 E, 273/65 R

[56] References Cited

U.S. PATENT DOCUMENTS

| | | | |
|---|---|---|---|
| 4,570,931 | 2/1986 | Martin | 273/65 EG |
| 4,991,842 | 2/1991 | Finley | 273/65 EG |
| 5,306,002 | 4/1994 | Meyer | 273/65 EG |

FOREIGN PATENT DOCUMENTS

| | | | |
|---|---|---|---|
| 583557 | 9/1959 | Canada | 273/65 EG |
| 600722 | 6/1960 | Canada | 273/65 EG |

*Primary Examiner*—Benjamin H. Layno

*Attorney, Agent, or Firm*—Bucknam and Archer

[57] ABSTRACT

A basketball leather cover having a plurality of raised portions aligned over the periphery, wherein the raised portions are made gradually smaller toward the top, having each a bottom of width within 0.5 mm to 3 mm and a uniform height within 0.5 mm to 3 mm. The raised portions may be made of horseshoe-like shape, annular shape, wave shape, V-shape, S-shape, circular shape, or shaped like fish scales.

6 Claims, 3 Drawing Sheets

RAISED SURFACE PATTERNS FOR BASKETBALL LEATHER COVERS

BACKGROUND OF THE INVENTION

The present invention relates to basketballs, and more particularly to raised surface patterns for basketball leather covers.

The game of basketball is widely accepted in most countries in the world, more particularly in those countries where there are professional basketball teams.

The surface of the leather cover of a basketball is not made smooth so that the basketball does not slip from the hand easily. U.S. Pat. No. 4,570,931 discloses a pattern of raised portions of triangular shape over the periphery of the leather cover for a basketball; Canada Pat. No. 600,722 discloses a pattern of raised portions of conical shape over the periphery of the leather cover for a basketball; Canada Pat. No. 583,557 discloses a pattern of raised portions of wave shape over the periphery of the leather cover for a rugby football.

SUMMARY OF THE INVENTION

The present invention provides raised surface patterns for basketball leather covers which greatly increase the friction force of the basketballs so that the basketballs do not slip from the hands. According to the present invention, the raised portions which are aligned over the periphery of the basketball leather cover are made gradually smaller toward the top, having each a bottom of width within 0.5 mm to 3 mm and a uniform height within 0.5 mm to 3 mm. The raised portions may be made of horseshoe-like shape, annular shape, wave shape, V-shape, S-shape, circular shape, or shaped like fish scales.

DETAILED DESCRIPTION OF THE PREFERRED EMBODIMENTS

Figure 1:
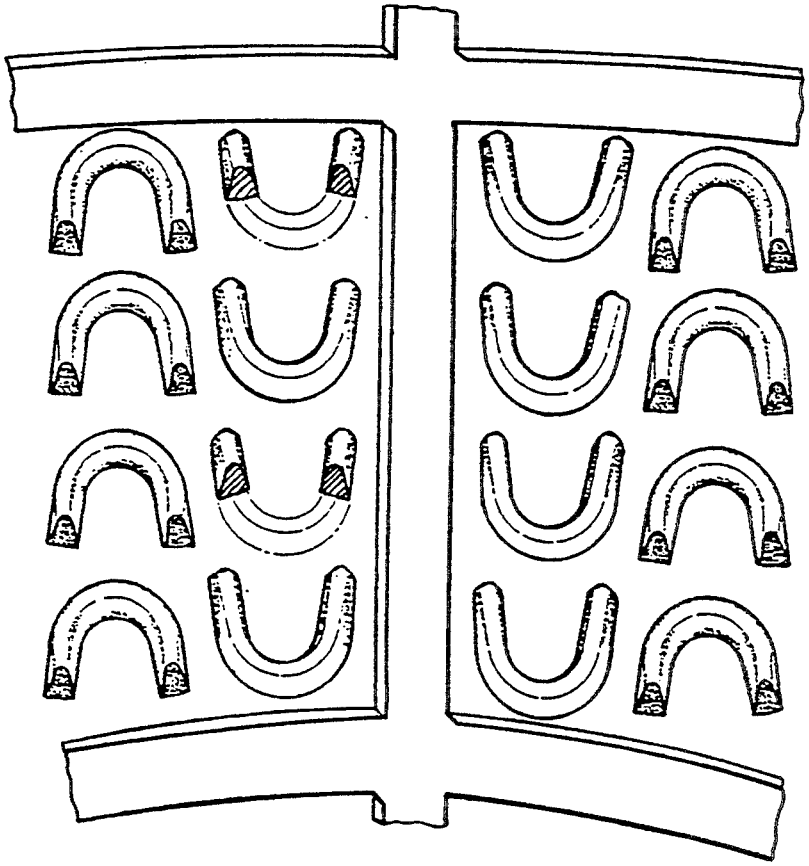
FIG. 1 shows a raised surface pattern of horseshoe-like shape for a basketball leather cover according to the present invention.
Figure 2:
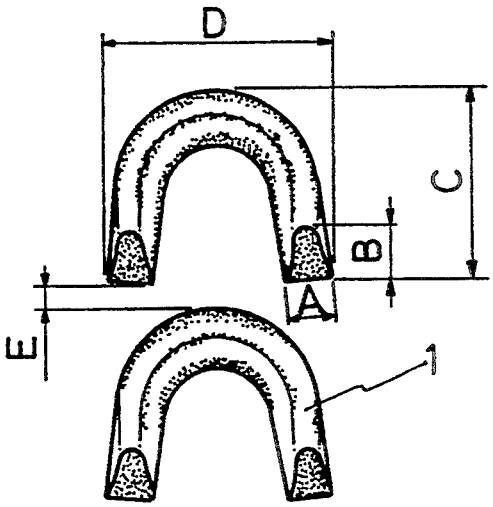
FIG. 2 shows the dimension of the raised portions shown in FIG. 1.

Referring to FIGS. 1 and 2, series of horseshoe-like raised portions 1 are alternatively arranged over the surface of the leather cover of a basketball in reversed directions. The thickness of the horseshoe-like raised portions 1 is made gradually smaller toward the top.

The width A of the bottom of the horseshoe-like raised portions 1 is within 0.5 mm to 3 mm. The height B of the horseshoe-like raised portions 1 is within 0.5 mm to 3 mm. The length C of the horseshoe-like raised portions 1 is within 3 mm to 20 mm. The total width of the horseshoe-like raised portions 1 is within 3 mm to 20 mm. The pitch E between two adjacent horseshoe-like raised portions 1 in the same line and same direction is within 2 mm to 10 mm. Because the height B is within 0.5 mm to 3 mm and the width A of the bottom of the horseshoe-like raised portions 1 is within 0.5 mm to 3 mm, an anti-skid surface is formed over the periphery of the basketball without affecting its roundness. This arrangement greatly increases the ground friction force of the basketball.

Figure 3:
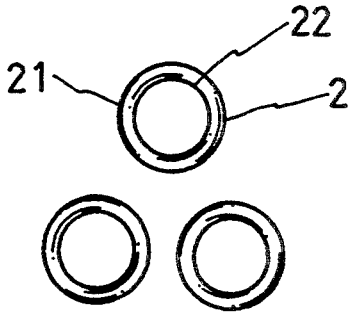
FIG. 3 shows a raised surface pattern of annular-shape for a basketball leather cover according to the present invention.

Referring to FIG. 3, the raised portions 2 are made of circular shape gradually smaller toward the top, having each an outer diameter 21 within 3 mm to 15 mm and an inner diameter 22 within 2 mm to 13 mm. The depth of the center recess of each circular raised portion 2 is within 0.5 mm to 3 mm. The pitch between either two adjacent raised portions 2 is within 2 mm to 10 mm.

Figure 4:
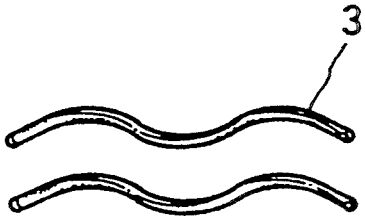
FIG. 4 shows a raised surface pattern of wave shape for a basketball leather cover according to the present invention.

Referring to FIG. 4, the raised portions 3 are made of wave shape. The thickness of the raised portions 3 is made gradually smaller toward the top. The distance between either two adjacent wave crests is within 10 mm to 30 mm. The height of the wave crests is within 1 mm to 3 mm. The pitch between either two parallel wave-like raised portions 3 is within 2 mm to 10 mm.

Figure 5:
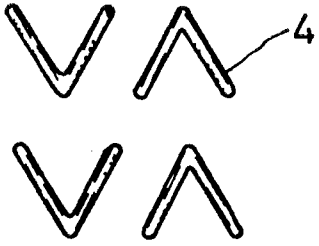
FIG. 5 shows a raised surface pattern of V-shape for a basketball leather cover according to the present invention.

Referring to FIG. 5, the raised portions 4 are made of V-shape. The thickness of the raised portions 4 is made gradually smaller toward the top. The width of the bottom of the raised portions 4 is within 0.5 mm to 3 mm. The height of the raised portions 4 is within 0.5 mm to 3 mm. The length of either side of the raised portions 4 is within 3 mm to 15 mm. The pitch between either two adjacent raised portions 4 is within 2 mm to 10 mm.

Figure 6:
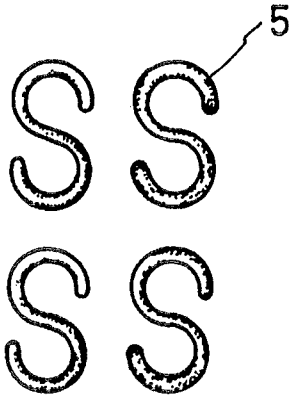
FIG. 6 shows a raised surface pattern of S-shape for a basketball leather cover according to the present invention.

Referring to FIG. 6, the raised portions 5 are made of S-shape. The thickness of the raised portions 5 is made gradually smaller toward the top. The length of the raised portions 5 is within 5 mm to 25 mm. The width of the raised portions 5 is within 5 mm to 15 mm. The pitch between either two adjacent raised portions 5 is within 2 mm to 10 mm.

Figure 7:
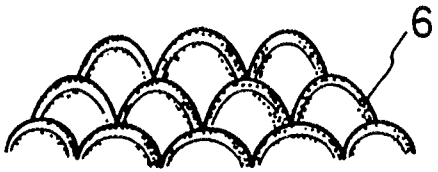
FIG. 7 shows a raised surface pattern arranged in the form of fish scales for a basketball leather cover according to the present invention.

Referring to FIG. 7, the raised portions 6 are made of arched shape and arranged together in the form of fish scales. The width of the bottom of the raised portions 6 is within 0.5 mm to 3 mm. The height of the raised portions 6 is within 0.5 mm to 3 mm. The arc length of the raised portions 6 is within 2 mm to 20 mm. The width between the crests of two adjacent arcs is within 2 mm to 20 mm.

Figure 8:
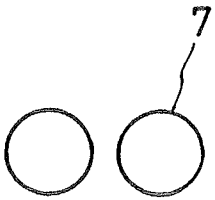
FIG. 8 shows a raised surface pattern of solid, circular shape for a basketball leather cover according to the present invention.

Referring to FIG. 8, the raised portions 7 are made of solid, circular shape. The diameter of the raised portions 7 is within 1 mm to 10 mm. The height of the raised portions 7 is within 0.5 mm to 3 mm. The pitch between either two adjacent raised portions 7 is within 2 mm to 10 mm.

According to either of the aforesaid embodiments, the raised portions on the leather cover of the basketball must be made identical and gradually smaller toward the top. The arrangement of the pitch between either two adjacent raised portions and the elastic material property of the raised portions greatly increase the friction force of the basketball therefore, the basketball can be stably controlled by the palm.

While only few embodiments of the present invention have been shown and described, it will be understood that various modifications and changes could be made without departing from the spirit and scope of the invention.

What is claimed is:

1. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raised portions are made of horseshoe-like shape longitudinally and transversely aligned, each two adjacent lines of raised portions being arranged in reversed directions, the length and width of the horseshoe-like shape being within 3 mm and 20 mm and its width being equal and within 3 mm to 20 mm, the pitch between either two raised portions being within 2 mm to 10 mm.

2. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raised portions are made of annular shape longitudinally and transversely aligned, defining each a circular recess, said raised portions having a uniform outer diameter within 3 mm to 15 mm and a uniform inner diameter within 2 mm to 13 mm, the depth of said circular recess being within 0.5 mm to 3 mm, the pitch between either two adjacent raised portions being within 2 mm to 10 mm.

3. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raised portions are made of wave shape, the distance between either two adjacent wave crests being within 10 mm to 30 mm, the height of the wave crests being within 1 mm to 3 mm, the pitch between either two parallel wave-like raised portions being within 2 mm to 10 mm.

4. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raisled portions are made of V-shape, the length of either side of the V-shape being equal and within 3 mm to 15 mm, the pitch between either two raised portions being within 2 mm to 10 mm.

5. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raised portions are made of S-shape of length within 5 mm to 25 mm and width within 5 mm to 16 mm, the pitch between either two raised portions being within 2 mm to 10 mm.

6. A basketball leather cover comprising a plurality of raised portions over the periphery, wherein said raised portions are made gradually smaller toward the top, having each a bottom of width within 0.5 mm to 3 mm and a uniform height within 0.5 mm to 3 mm, and wherein said raised portions are made of arched shape and arranged in the form of fish scales, the arc length being within 2 mm to 20 mm, the width between the crests of two adjacent arcs being within 2 mm to 20 mm.

* * * * *